US009709934B2

(12) United States Patent
Masuda

(10) Patent No.: US 9,709,934 B2
(45) Date of Patent: Jul. 18, 2017

(54) IMAGE FORMING APPARATUS THAT DETERMINES ABNORMALITY IN SIGNAL WIRE

(71) Applicant: KYOCERA Document Solutions Inc., Osaka (JP)

(72) Inventor: Masatoshi Masuda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/164,252

(22) Filed: May 25, 2016

(65) Prior Publication Data

US 2016/0349679 A1 Dec. 1, 2016

(30) Foreign Application Priority Data

May 29, 2015 (JP) ..... 2015-109597

(51) Int. Cl.
*G03G 15/20* (2006.01)
*G03G 15/00* (2006.01)

(52) U.S. Cl.
CPC ..... *G03G 15/2039* (2013.01); *G03G 15/2078* (2013.01); *G03G 15/80* (2013.01)

(58) Field of Classification Search
CPC ..... G03G 15/2039; G03G 15/2078; G03G 15/205
See application file for complete search history.

(56) References Cited

U.S. PATENT DOCUMENTS

2008/0187333 A1* 8/2008 Hwang ..... G03G 15/2039 399/33

FOREIGN PATENT DOCUMENTS

JP 2007-025010 A 2/2007
JP 2010230477 A * 10/2010

* cited by examiner

*Primary Examiner* — David M Gray
*Assistant Examiner* — Laura Roth
(74) *Attorney, Agent, or Firm* — Studebaker & Brackett PC

(57) ABSTRACT

An image forming apparatus includes a heating roller, a temperature sensor, a controller, a signal wire, and a first resistor. The temperature sensor detects the temperature of a heating roller. The controller has a processor. The signal wire transmits a signal of the temperature sensor to the controller (input terminal). The first resistor is disposed between an output terminal of the controller and the signal wire. The controller includes a voltage application unit, a voltage detection unit, and a determination unit. The voltage application unit applies a voltage to the output terminal. The voltage detection unit detects a voltage value of the input terminal. The determination unit determines whether or not an abnormality occurs in the signal wire, on the basis of the voltage value detected by the voltage detection unit.

6 Claims, 7 Drawing Sheets

IMAGE FORMING APPARATUS THAT DETERMINES ABNORMALITY IN SIGNAL WIRE

INCORPORATION BY REFERENCE

The present application claims priority under 35 U.S.C. §119 to Japanese Patent Application No. 2015-109597, filed May 29, 2015. The contents of this application are incorporated herein by reference in their entirety.

BACKGROUND

The present disclosure relates to image forming apparatuses.

It is commonly known that, in a fixing device included in an image forming apparatus, the temperature of a heating roller is detected using a temperature sensor. There are also a variety of techniques of detecting a wire break in a temperature sensor.

For example, an image forming apparatus has been disclosed in which a wire break in the temperature sensor is detected during turning on of the apparatus. Specifically, in this image forming apparatus, when information about a wire break in the temperature sensor has been recorded in a memory, power is supplied at a low duty cycle to a heater of the heating roller during turning on of the apparatus. In this image forming apparatus, a wire break in the temperature sensor is also detected while power continues to be supplied to the heater.

According to this image forming apparatus, when the apparatus is turned on again, the apparatus can be activated without the heater being heated to high temperature.

SUMMARY

An image forming apparatus according to the present disclosure for forming an image on a recording medium includes a heating roller, a temperature sensor, a controller, a signal wire, and a first resistor. The temperature sensor detects the temperature of a heating roller. The controller has a processor. The signal wire transmits a signal of the temperature sensor to the controller. The first resistor is disposed between the controller and the signal wire. The first resistor is disposed between the controller and the signal wire. The controller includes a voltage application unit, a voltage detection unit, and a determination unit. The voltage application unit applies a voltage to an end of the first resistor opposite from the signal wire. The voltage detection unit detects a voltage value of an end of the first resistor coupled with the signal wire. The determination unit determines whether or not an abnormality occurs in the signal wire, on the basis of the voltage value detected by the voltage detection unit.

DETAILED DESCRIPTION

Embodiments of the present disclosure will now be specifically described with reference to the accompanying drawings (FIGS. 1-6). Note that the same or corresponding parts are designated by the same reference signs throughout the several views, and will not be redundantly described.

Figure 1:
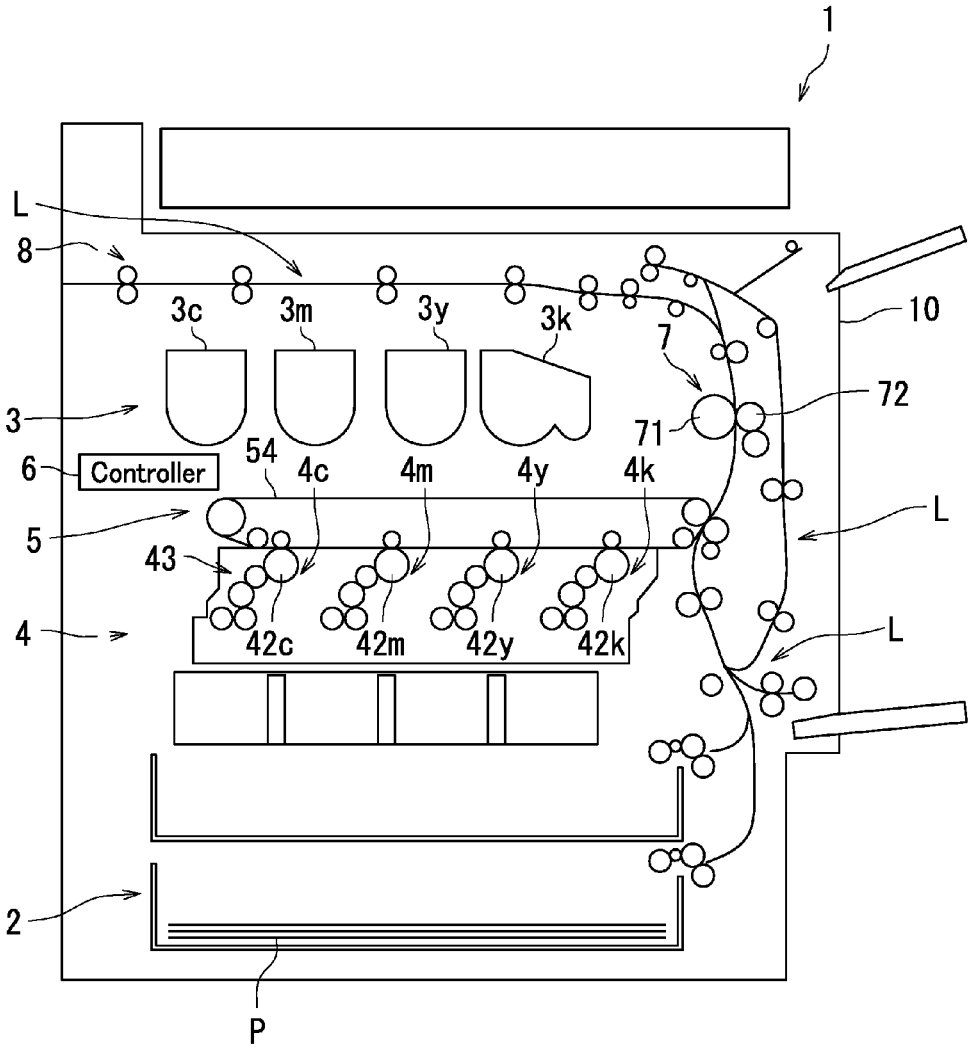
FIG. 1 is a side view illustrating a configuration of an image forming apparatus according to an embodiment of the present disclosure.

Firstly, an image forming apparatus 1 according to this embodiment will be described with reference to FIG. 1. FIG. 1 is a diagram showing a configuration of the image forming apparatus 1 according to this embodiment. In this embodiment, the image forming apparatus 1 is a color copier.

As illustrated in FIG. 1, the image forming apparatus 1, which forms an image on paper P, includes a housing 10, a paper feeder 2, a conveyance unit L, a toner supply unit 3, an image forming unit 4, a transfer unit 5, a controller 6, a fixing unit 7, and a paper output unit 8.

The paper feeder 2, which is disposed in a lower portion of the housing 10, feeds paper P to the conveyance unit L. The paper feeder 2 can store a plurality of sheets of paper P, and feed the top sheet of paper P to the conveyance unit L one at a time.

The conveyance unit L conveys paper P fed by the paper feeder 2 to the paper output unit 8 through the transfer unit 5 and the fixing unit 7.

The toner supply unit 3, which is a container for supplying toner to the image forming unit 4, includes four toner cartridges 3*c*, 3*m*, 3*y*, and 3*k*. The toner cartridge 3*c* contains cyan toner. The toner cartridge 3*m* contains magenta toner. The toner cartridge 3*y* contains yellow toner. The toner cartridge 3*k* contains black toner.

The transfer unit 5 includes an intermediate transfer belt 54. The transfer unit 5 transfers, to paper P, a toner image which has been formed on the intermediate transfer belt 54 by the image forming unit 4.

The image forming unit 4 forms a toner image on the intermediate transfer belt 54. The image forming unit 4 includes four image forming sections 4*c*, 4*m*, 4*y*, and 4*k*. The image forming section 4*c* is supplied with cyan toner from the toner cartridge 3*c*. The image forming section 4*m* is supplied with magenta toner from the toner cartridge 3*m*. The image forming section 4*y* is supplied with yellow toner from the toner cartridge 3*y*. The image forming section 4*k* is supplied with black toner from the toner cartridge 3*k*.

The fixing unit 7 includes a pair of rollers, i.e., a heating roller 7*l* and a pressure roller 72, for fixing a toner image which has been formed on paper P by the transfer unit 5. Paper P is heated and pressed by the heating roller 71 and the pressure roller 72. As a result, the fixing unit 7 fixes an unfixed toner image which has been transferred to paper P by the transfer unit 5. The paper output unit 8 outputs paper P bearing a fixed toner image from the apparatus.

Figure 2:
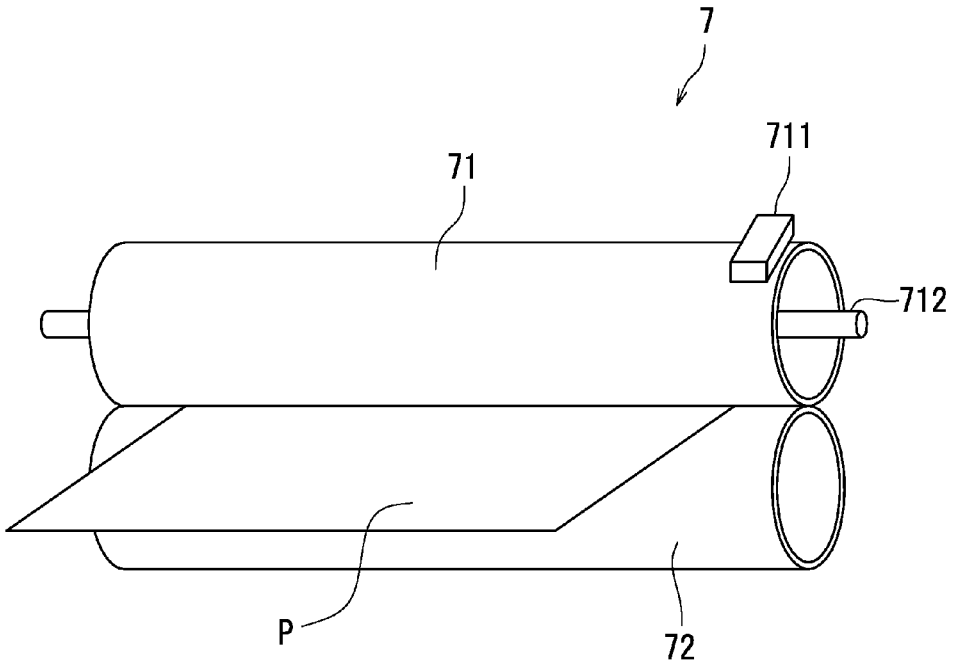
FIG. 2 is a perspective view illustrating a configuration of a fixing unit illustrated in FIG. 1.

Next, a configuration of the fixing unit 7 will be described with reference to FIG. 2. FIG. 2 is a perspective view showing a configuration of the fixing unit 7. The fixing unit 7 includes a non-contact temperature sensor 711 and a heater 712 in addition to the heating roller 71 and the pressure roller 72.

The non-contact temperature sensor 711 detects the temperature TR of the heating roller 71 in a non-contact fashion.

Specifically, the non-contact temperature sensor 711 includes a thermopile. The thermopile converts thermal energy from the heating roller 71 into electrical energy. The non-contact temperature sensor 711 corresponds to an example of a "temperature sensor."

The heater 712 heats the heating roller 71. The heater 712 includes, for example, a halogen lamp. The heating roller 71 is heated by the radiant heat of the halogen lamp.

Figure 3:
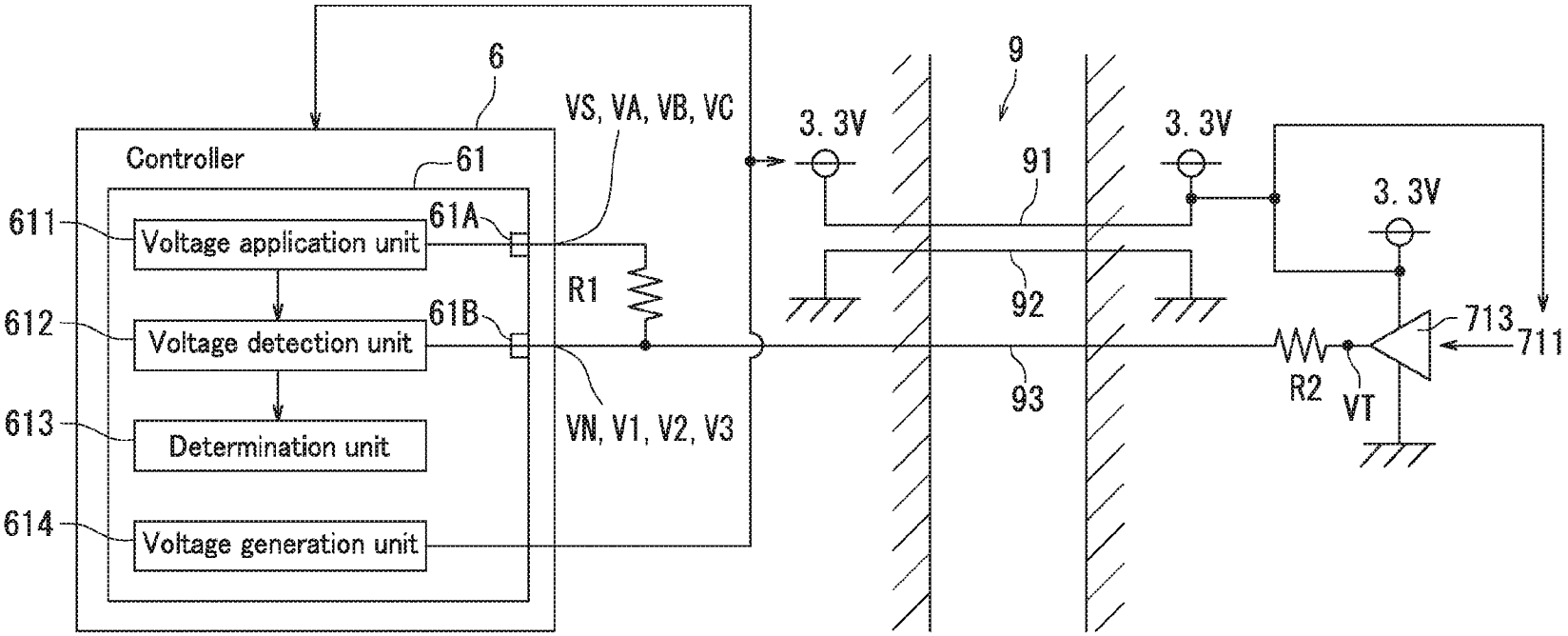
FIG. 3 is a diagram illustrating a configuration of a controller illustrated in FIG. 1.

Next, a configuration of the controller 6 will be described with reference to FIG. 3. FIG. 3 is a diagram showing a configuration of the controller 6. The controller 6 includes a central processing unit (CPU) 61, a read only memory (ROM) (not illustrated), and a random access memory (RAM) (not illustrated). The controller 6 implements the CPU 61, the ROM, and the RAM. The ROM stores a control program. The CPU 61 reads the control program from the ROM and executes the control program. The CPU 61 includes a voltage application unit 611, a voltage detection unit 612, a determination unit 613, and a voltage generation unit 614. The CPU 61 implements the voltage application unit 611, the voltage detection unit 612, the determination unit 613, and the voltage generation unit 614. The RAM functions as a work area for the CPU 61. The CPU 61 further includes an output terminal 61A and an input terminal 61B. The CPU 61 corresponds to an example of a processor. Note that the processor may be a micro-processing unit (MPU), an integrated circuit, or the like other than the CPU.

The image forming apparatus 1 includes a wire harness 9. The wire harness 9 includes a power supply wire 91, a ground wire 92, and a signal wire 93. The power supply wire 91 supplies a voltage generated by the voltage generation unit 614 to the non-contact temperature sensor 711. The ground wire 92 connects a ground terminal of the controller 6 with a terminal of the non-contact temperature sensor 711. As a result, the terminal of the non-contact temperature sensor 711 serves as a ground terminal. The signal wire 93 transmits a detection signal of the non-contact temperature sensor 711 to the controller 6.

The image forming apparatus 1 further includes an amplifier 713, a first resistor R1, and a second resistor R2. The amplifier 713 is disposed between the non-contact temperature sensor 711 and the signal wire 93. The amplifier 713 amplifies the detection signal of the non-contact temperature sensor 711. The first resistor R1 is disposed between the output terminal 61A and the input terminal 61B so that the controller 6 detects an abnormality in the power supply wire 91 and the signal wire 93. The second resistor R2 is disposed between the amplifier 713 and the signal wire 93 so that the controller 6 calculates the temperature TR of the heating roller 71 from the detection signal of the non-contact temperature sensor 711.

The output terminal 61A outputs a voltage set by the voltage application unit 611 to one (the upper end in FIG. 3) of the two opposite ends of the first resistor R1. Note that the output terminal 61A corresponds to a "first end." The input terminal 61B receives an output signal from the non-contact temperature sensor 711 through the amplifier 713, the second resistor R2, and the signal wire 93 in this sequence. The signal (voltage VN) input to the input terminal 61B is output to the voltage detection unit 612.

The voltage generation unit 614 generates a DC voltage which is to be supplied to the non-contact temperature sensor 711 and the amplifier 713, from an AC voltage supplied from a commercial power supply. The DC voltage generated by the voltage generation unit 614 is 3.3 V in this embodiment. The DC voltage generated by the voltage generation unit 614 is supplied to the non-contact temperature sensor 711 and the amplifier 713 through the power supply wire 91.

The voltage application unit 611 applies to a voltage VS to the output terminal 61A. Specifically, the voltage application unit 611 applies a high voltage VA (e.g., 3.3 V) to the output terminal 61A when the controller 6 detects an abnormality in the signal wire 93. The voltage application unit 611 applies a low voltage VB (e.g., 0 (zero) V) to the output terminal 61A when the controller 6 detects an abnormality in the power supply wire 91. The voltage application unit 611 puts the output terminal 61A into an open state (high impedance state) when the controller 6 calculates the temperature detected by the non-contact temperature sensor 711.

The voltage detection unit 612 detects the voltage value of the voltage VN of the input terminal 61B. Based on the voltage value of the voltage VN detected by the voltage detection unit 612, the determination unit 613 detects an abnormality in the signal wire 93 or the power supply wire 91. Based on the voltage value of the voltage VN, the determination unit 613 calculates the temperature TR of the heating roller 71. The determination unit 613 corresponds to an example of a "temperature detection unit."

As described above with reference to FIG. 3, the controller 6 (the CPU 61) can detect an abnormality in the non-contact temperature sensor 711 without supplying power to the heater 712. Specifically, the CPU 61 can detect an abnormality in the signal wire 93 for the non-contact temperature sensor 711, and an abnormality in the power supply wire 91.

Figure 4:
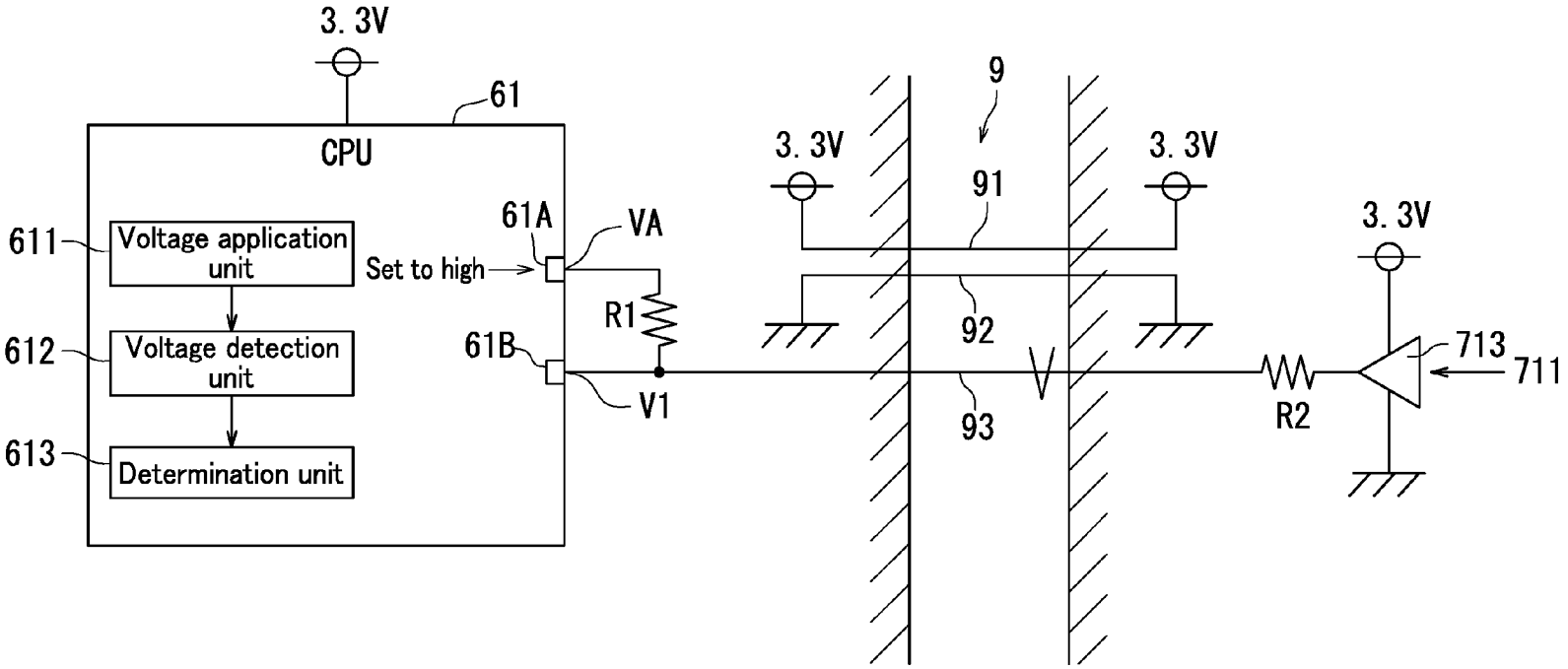
FIG. 4 is a diagram illustrating a first function of the controller illustrated in FIG. 1.
Figure 5:
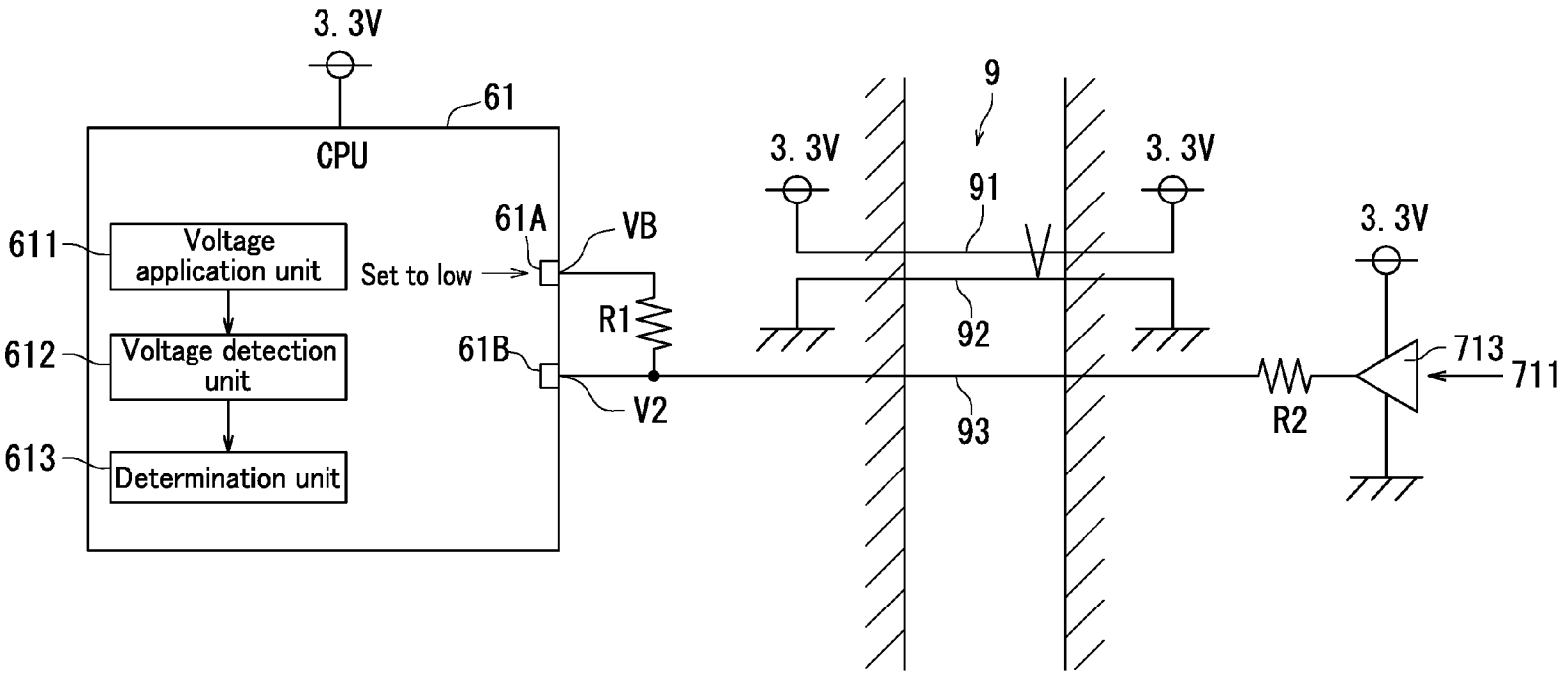
FIG. 5 is a diagram illustrating a second function of the controller illustrated in FIG. 1.
Figure 6:
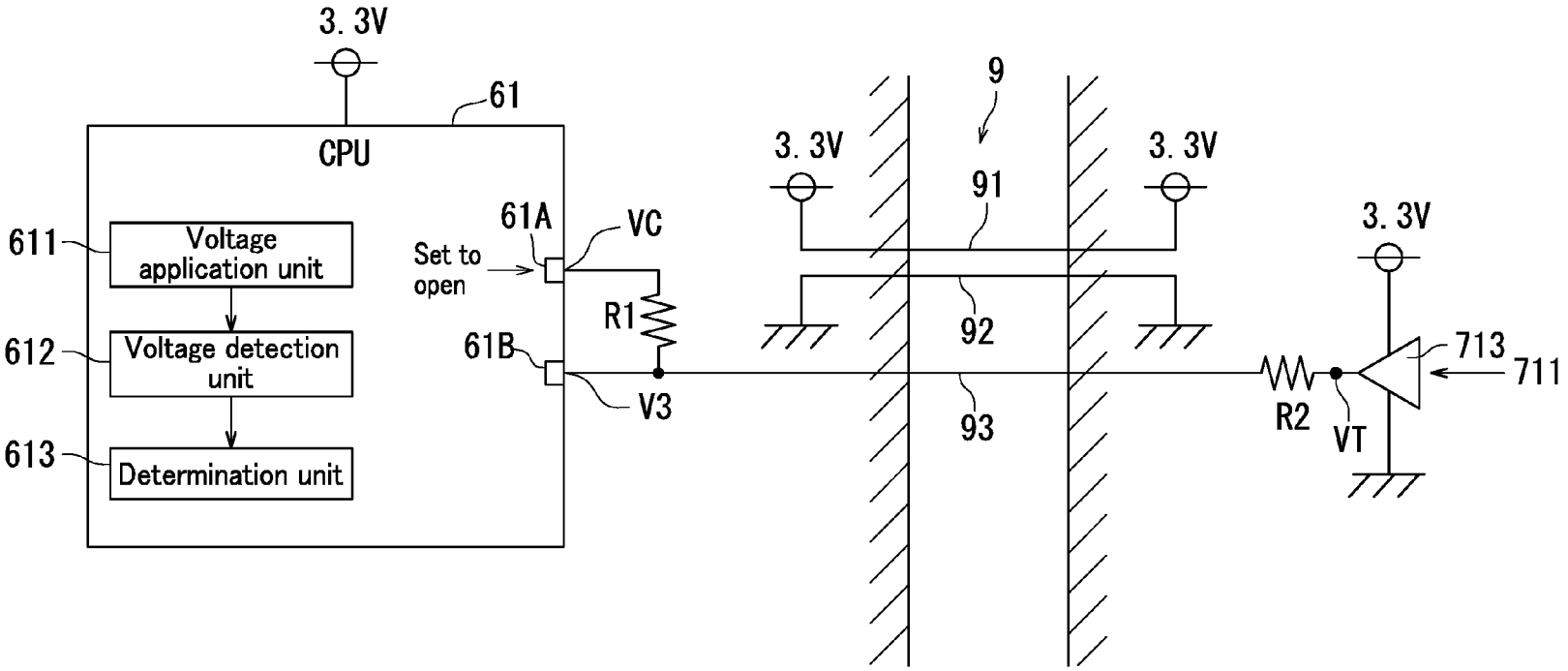
FIG. 6 is a diagram illustrating a third function of the controller illustrated in FIG. 1.

A first function of the controller 6 which is to detect an abnormality in the signal wire 93, a second function of the controller 6 which is to detect an abnormality in the power supply wire 91, and a third function of the controller 6 which is to detect the temperature TR of the heating roller 71 using the non-contact temperature sensor 711, will be described with reference to FIGS. 4-6.

Firstly, the first function of the controller 6 which is to detect an abnormality in the signal wire 93 will be described with reference to FIG. 4. FIG. 4 is a diagram showing the first function of the controller 6. The voltage application unit 611 applies the high voltage VA (3.3 V in this embodiment) to the output terminal 61A. The voltage detection unit 612 detects the voltage V1 of the input terminal 61B. The high voltage VA corresponds to a "first DC voltage" and a "second DC voltage."

When a break occurs in the signal wire 93, the high voltage VA applied by the output terminal 61A is not divided by the first resistor R1 and the second resistor R2 through the signal wire 93. In addition, the detection voltage detected by the non-contact temperature sensor 711 is not input to the input terminal 61B through the amplifier 713 and the second resistor R2. Therefore, the input terminal 61B receives a voltage having the same voltage value as the voltage value of the high voltage VA applied to the output terminal 61A. Therefore, when a break occurs in the signal wire 93, the voltage V1 of the input terminal 61B is the high voltage VA. When the voltage value of the voltage V1 of the input terminal 61B detected by the voltage detection unit 612 is equal to the voltage value of the high voltage VA, the determination unit 613 determines that a break occurs in the signal wire 93.

Meanwhile, when a ground fault occurs in the signal wire 93, the output terminal 61A is connected to the ground through the first resistor R1 and the signal wire 93. Therefore, the voltage V1 of the input terminal 61B is 0 (zero) V. When the voltage value of the voltage V1 of the input terminal 61B detected by the voltage detection unit 612 is 0 (zero) V, the determination unit 613 determines that a ground fault occurs in the signal wire 93.

As described above with reference to FIG. 4, the voltage application unit 611 applies the high voltage VA to the output terminal 61A, and the voltage detection unit 612 detects the voltage value of the voltage V1 of the input terminal 61B. Thereafter, when the voltage value of the voltage V1 is equal to the voltage value of the high voltage VA, the determination unit 613 determines that a break occurs in the signal wire 93. Thus, a break in the signal wire 93 can be detected without supplying power to the heater 712.

When the detected voltage value of the voltage V1 is 0 (zero) V, the determination unit 613 determines that a ground fault occurs in the signal wire 93. Thus, a ground fault in the signal wire 93 can be detected without supplying power to the heater 712.

Next, the second function of the controller 6 which is to detect an abnormality in the power supply wire 91 will be described with reference to FIG. 5. FIG. 5 is a diagram showing the second function of the controller 6. The voltage application unit 611 applies the low voltage VB (0 (zero) V in this embodiment) to the output terminal 61A. The voltage detection unit 612 detects the voltage value of the voltage V1 of the input terminal 61B.

When a break occurs in the power supply wire 91, a voltage is applied to neither the non-contact temperature sensor 711 nor the amplifier 713. Similarly, when a ground fault occurs in the power supply wire 91, a voltage is applied to neither the non-contact temperature sensor 711 nor the amplifier 713. In the above configuration, the detection voltage detected by the non-contact temperature sensor 711 is not input to the input terminal 61B through the amplifier 713 and the second resistor R2. Therefore, the voltage value of the voltage V2 of the input terminal 61B is substantially equal to the voltage value of the output terminal 61A. As a result, the voltage value of the voltage V2 of the input terminal 61B drops to substantially 0 (zero) V. When the voltage value of the voltage V2 of the input terminal 61B detected by the voltage detection unit 612 is substantially 0 (zero) V, the determination unit 613 determines that a break or a ground fault occurs in the power supply wire 91.

As described above with reference to FIG. 5, the voltage application unit 611 applies the low voltage VB to the output terminal 61A, and the voltage detection unit 612 detects the voltage value of the voltage V2 of the input terminal 61B. Thereafter, when the detected voltage value of the voltage V2 is substantially 0 (zero) V, the determination unit 613 determines that a break or a ground fault occurs in the power supply wire 91. Thus, a break and a ground fault in the power supply wire 91 can be detected without supplying power to the heater 712.

Next, the third function of the controller 6 which is to detect the temperature TR of the heating roller 71 using the non-contact temperature sensor 711 will be described with reference to FIG. 6. FIG. 6 is a diagram showing the third function of the controller 6. The voltage application unit 611 puts the output terminal 61A into the open state. The voltage detection unit 612 detects the voltage value of the voltage V3 of the input terminal 61B.

When the output terminal 61A is put into the open state, the output terminal 61A is set to 3.3 V. In this situation, a current does not flow through the output terminal 61A. Therefore, a potential difference between the output terminal 61A and the output of the amplifier 713 is divided by the first resistor R1 and the second resistor R2. Therefore, a voltage applied to the opposite ends of the second resistor R2 is represented by Expression (1) below.

$$(3.3-VT)\times R2/(R1+R2) \quad (1)$$

where VT represents the voltage of the output of the amplifier 713, R1 represents the resistance value of the first resistor R1, and R2 represents the resistance value of the second resistor R2.

Therefore, the voltage V3 is represented by Expression (2) below.

$$V3=(3.3-VT)\times R2/(R1+R2)+VT \quad (2)$$

The voltage VT is obtained from Expression (2) and represented by Expression (3) below:

$$VT=3.3\times R2/R1-V3\times(R1+R2)/R1 \quad (3)$$

For example, when the resistance value of the first resistor R1 is 120 kΩ, and the resistance value of the second resistor R2 is 30 kΩ, Expression (3) is represented by Expression (4) below.

$$VT=0.825-1.25\times V3 \quad (4)$$

Thus, the determination unit 613 can calculate the voltage VT using Expression (4). The amplification rate of the amplifier 713 and the characteristics of the non-contact temperature sensor 711 are previously known. Therefore, the determination unit 613 can calculate the temperature TR of the heating roller 71 from the voltage VT.

As described above with reference to FIG. 6, the voltage application unit 611 puts the output terminal 61A into the open state, and the voltage detection unit 612 detects the voltage value of the voltage V3 of the input terminal 61B. Thereafter, the determination unit 613 can calculate the voltage VT from the voltage V3, and then the temperature TR of the heating roller 71 from the voltage VT, i.e., can obtain the temperature TR detected by the non-contact temperature sensor 711.

Figure 7:
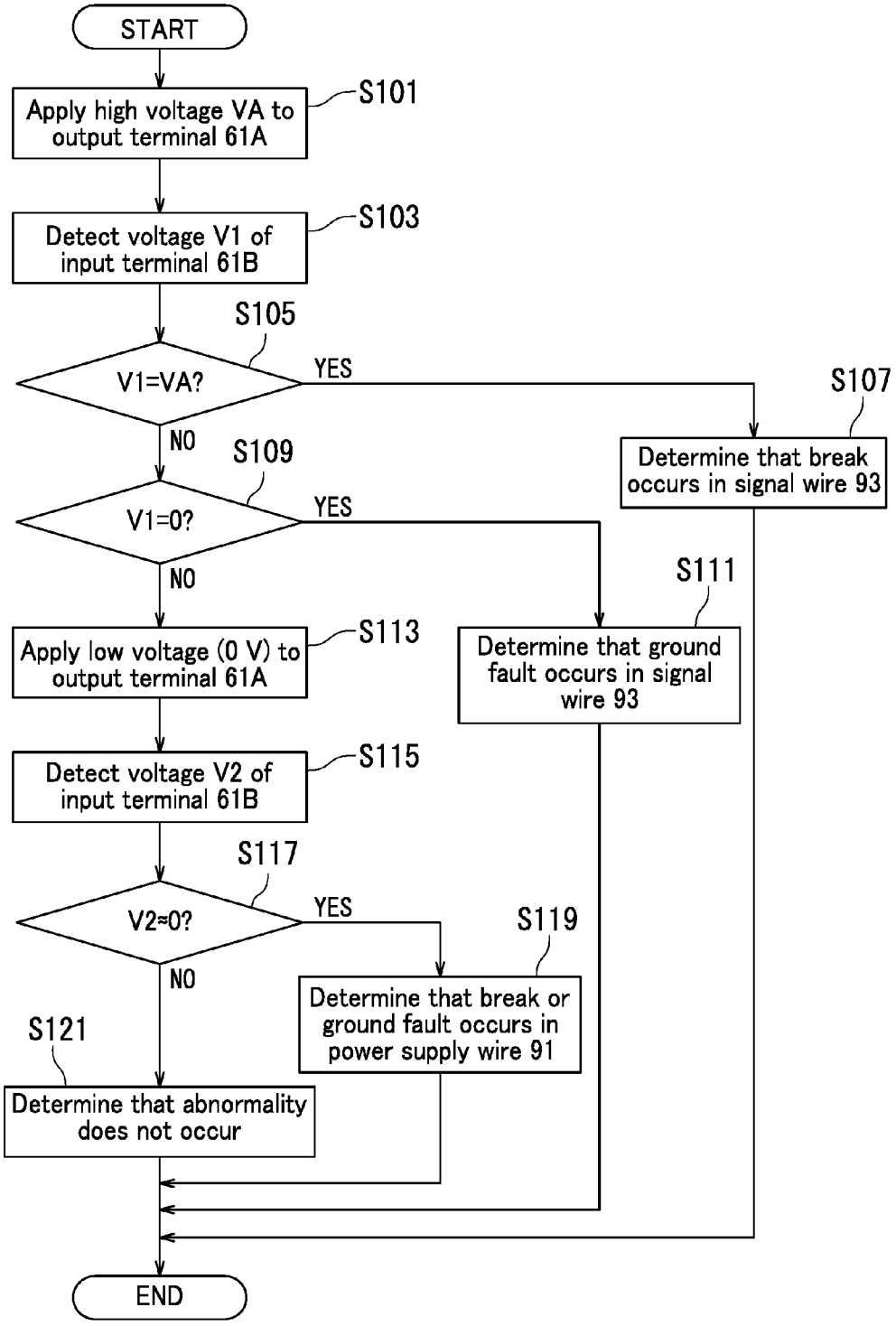
FIG. 7 is a flowchart illustrating an operation of the controller illustrated in FIG. 1.

Next, an operation of the controller 6 will be described with reference to FIG. 7. FIG. 7 is a flowchart showing an operation of the controller 6. A case where the controller 6 detects an abnormality in the signal wire 93 and the power supply wire 91 will be described with reference to FIG. 7. Initially, the voltage application unit 611 applies the high voltage VA to the output terminal 61A (step S101). Thereafter, the voltage detection unit 612 detects the voltage value of the voltage V1 of the input terminal 61B (step S103). Next, the determination unit 613 determines whether or not the voltage value of the voltage V1 is equal to the voltage value of the high voltage VA (step S105).

When the determination unit 613 determines that the voltage value of the voltage V1 is not equal to the voltage value of the high voltage VA (NO in step S105), control proceeds to step S109. When the determination unit 613 determines that the voltage value of the voltage V1 is equal to the voltage value of the high voltage VA (YES in step S105), the determination unit 613 determines that a break occurs in the signal wire 93 (step S107), and the process is ended.

When No in step S105, the determination unit 613 determines whether or not the voltage value of the voltage V1 detected in step S103 is 0 (zero) V (step S109). When the determination unit 613 determines that the voltage value of the voltage V1 is not 0 (zero) V (NO in step S109), control proceeds to step S113. When the determination unit 613 determines that the voltage value of the voltage V1 is 0 (zero) V (YES in step S109), the determination unit 613 determines that a ground fault occurs in the signal wire 93 (step S111), and the process is ended.

When NO in step S109, the voltage application unit 611 applies the low voltage VB (0 (zero) V in this embodiment) to the output terminal 61A (step S113). Next, the voltage detection unit 612 detects the voltage value of the voltage V2 of the input terminal 61B (step S115). Thereafter, the determination unit 613 determines whether or not the detected voltage value of the voltage V2 is substantially 0 (zero) V (step S117).

When the determination unit 613 determines that the voltage value of the voltage V2 is not substantially 0 (zero) V (NO in step S117), control proceeds to step S121. When the determination unit 613 determines that the voltage value of the voltage V2 is substantially 0 (zero) V (YES in step S117), the determination unit 613 determines that a break or a ground fault occurs in the power supply wire 91 (step S119), and the process is ended.

When NO in step S117, the determination unit 613 determines that an abnormality does not occur (step S121), and the process is ended.

As described above with reference to FIG. 7, an abnormality in the non-contact temperature sensor 711 can be detected without supplying power to the heater 712.

In the foregoing, embodiments of the present disclosure have been described with reference to the drawings. Note that the present disclosure is not limited to the above embodiments, and may be applied to various alternative embodiments without departing the spirit and scope of the present disclosure (e.g., (1) and (2) described below). The drawings mainly illustrate the components schematically for ease of understanding. The thicknesses, lengths, number, etc., of the components illustrated are not to scale for the sake of convenience of illustration. The shapes, dimensions, etc., of the components illustrated in the above embodiments are only for illustrative purposes and are not particularly limited, and may be changed and modified without substantially departing the configuration of the present disclosure.

(1) In this embodiment, an example in which the determination unit 613 calculates the temperature TR detected by the non-contact temperature sensor 711 has been described. The present disclosure is not limited to this. The controller 6 may include a temperature detection unit for calculating the temperature TR detected by the non-contact temperature sensor 711, in addition to the determination unit 613.

(2) In this embodiment, an example in which the voltage value of the high voltage VA is equal to the voltage value (3.3 V) of the drive voltage of the CPU 61 has been described. The present disclosure is not limited to this. The voltage value of the high voltage VA may be lower than or equal to the voltage value of the drive voltage of the CPU 61 (e.g., 2 V).

What is claimed is:

1. An image forming apparatus for forming an image on a recording medium, comprising:

a heating roller;

a temperature sensor configured to detect a temperature of the heating roller;

a controller having a processor;

a signal wire configured to transmit a signal of the temperature sensor to the controller; and a first resistor disposed between the controller and the signal wire, wherein the controller includes a voltage application unit configured to apply a voltage to a first end of the first resistor opposite from the signal wire, a voltage detection unit configured to detect a voltage value of a second end of the first resistor coupled with the signal wire, and a determination unit configured to determine whether or not an abnormality occurs in the signal wire, on the basis of the voltage value detected by the voltage detection unit, the controller further includes a voltage generation unit configured to generate a predetermined second DC voltage, the image forming apparatus further includes a power supply wire configured to supply the second DC voltage generated by the voltage generation unit to the temperature sensor, the determination unit determines whether or not an abnormality occurs in the power supply wire, on the basis of the voltage value detected by the voltage detection unit, the image forming apparatus further includes an amplifier disposed between the temperature sensor and the signal wire, the amplifier amplifies the detection signal of the temperature sensor, and the voltage generation unit supplies the second DC voltage to the amplifier through the power supply wire.

2. The image forming apparatus according to claim 1, wherein the voltage application unit applies a predetermined first DC voltage to the first end, and the determination unit determines whether or not an abnormality occurs in the signal wire, on the basis of the voltage value detected by the voltage detection unit.

3. The image forming apparatus according to claim 2, wherein the determination unit determines that a break occurs in the signal wire when the voltage value detected by the voltage detection unit is substantially equal to the voltage value of the first DC voltage.

4. The image forming apparatus according to claim 1, wherein the voltage application unit applies a predetermined first DC voltage to the first end, and the determination unit determines that a ground fault occurs in the signal wire when the voltage value detected by the voltage detection unit is substantially zero volts.

5. The image forming apparatus according to claim 1, wherein the voltage application unit applies a voltage of zero volts to the first end, and the determination unit determines that a break or a ground fault occurs in the power supply wire when the voltage value detected by the voltage detection unit is substantially zero volts.

6. An image forming apparatus, for forming an image on a recording medium, comprising:

a heating roller;

a temperature sensor configured to detect a temperature of the heating roller;

a controller having a processor;

a signal wire configured to transmit a signal of the temperature sensor to the controller; and a first resistor disposed between the controller and the signal wire, wherein the controller includes a voltage application unit configured to apply a voltage to a first end of the first resistor opposite from the signal wire, a voltage detection unit configured to detect a voltage value of a second end of the first resistor coupled with the signal wire, and a determination unit configured to determine whether or not an abnormality occurs in the signal wire, on the basis of the voltage value detected by the voltage detection unit, the image forming apparatus further comprises a second resistor disposed between the temperature sensor and the signal wire, the controller further includes a temperature detection unit configured to calculate the temperature of the heating roller, the voltage application unit puts the first end of the first resistor into a high impedance state, and the temperature detection unit calculates the temperature of the heating roller based on the voltage value detected by the voltage detection unit.

* * * * *